US009840310B2

(12) United States Patent
Smith et al.

(10) Patent No.: US 9,840,310 B2
(45) Date of Patent: Dec. 12, 2017

(54) MARINE SUSPENSION SYSTEM

(71) Applicants: David Alvin Smith, Sidney (CA); Lee Michael Adams, Parksville (CA)

(72) Inventors: David Alvin Smith, Sidney (CA); Lee Michael Adams, Parksville (CA)

(73) Assignee: Professional Components Ltd., Sidney, BC (CA)

( * ) Notice: Subject to any disclaimer, the term of this patent is extended or adjusted under 35 U.S.C. 154(b) by 164 days.

(21) Appl. No.: 15/056,054

(22) Filed: Feb. 29, 2016

(65) Prior Publication Data

US 2016/0257381 A1 Sep. 8, 2016

Related U.S. Application Data

(60) Provisional application No. 62/126,932, filed on Mar. 2, 2015.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
USPC ..... 114/363, 343; 267/131
See application file for complete search history.

(56) References Cited

U.S. PATENT DOCUMENTS 2,617,337 A 11/1952 Evans
3,237,906 A 3/1966 Heyl, Jr.
4,349,167 A 9/1982 Reilly
4,911,381 A * 3/1990 Cannon ..... B64D 11/0696 244/122 R
5,542,371 A 8/1996 Harvey et al.
6,098,567 A * 8/2000 Ullman ..... B63B 29/04 114/363
6,182,596 B1 2/2001 Johnson
(Continued)

FOREIGN PATENT DOCUMENTS

WO 1992/012892 8/1992
WO 2006035229 A2 4/2006

OTHER PUBLICATIONS

Canadian Intellectual Property Office,International Search Report, dated Jun. 13, 2012, 2 pages.

*Primary Examiner* — Lars A Olson
*Assistant Examiner* — Jovon Hayes
(74) *Attorney, Agent, or Firm* — Tomlinson McKinstry, P.C.

(57) ABSTRACT

A seat module suspension system for a high-speed water vessel including a guide assembly for permitting a range of substantially vertical travel of the seat module, an air shock within the guide assembly for resiliently suspending the seat module; and a support assembly extending for impeding athwart movement of a forward projecting portion of the seat module. The support assembly includes a spar pivotally mounted at one end the base of the guide assembly and pivotally mounted at the other end to a mount attached to the underside of the forward projecting portion and configured to permit fore and aft movement, so as to accommodate substantially vertical movement of the seat module. The system also includes a second air shock connected to the support assembly to impede the fore and aft movement and thus support the forward projecting portion of the seat module.

20 Claims, 6 Drawing Sheets

(56) References Cited

U.S. PATENT DOCUMENTS

| | | | | |
|---|---|---|---|---|
| 6,237,889 | B1 * | 5/2001 | Bischoff | B60N 2/0228 180/902 |
| 6,786,172 | B1 * | 9/2004 | Loffler | B63B 17/0081 114/363 |
| 6,892,666 | B1 | 5/2005 | Plante et al. | |
| 7,434,525 | B2 * | 10/2008 | Hodge | B63B 39/005 114/71 |
| 8,307,773 | B2 * | 11/2012 | Smith | B60N 2/504 114/363 |
| 9,016,226 | B2 * | 4/2015 | Smith | B63B 17/0081 114/122 |
| 2016/0257381 | A1 * | 9/2016 | Smith | B63B 29/04 |

* cited by examiner 230
204
222
202
152
210
160
250
208
254
290
232
234

204
202
200
290
270
208

231
230
236
206
202

204
208

204
202
208

232
230
206
236
202

MARINE SUSPENSION SYSTEM

CROSS REFERENCE TO RELATED APPLICATIONS

This application claims the benefit of U.S. Provisional Patent Application No. 62/126,932 filed 2 Mar. 2015.

FIELD

The present invention relates to a marine suspension system. More particularly, the present invention relates to a marine suspension system for use in high-speed watercraft.

BACKGROUND

High-speed small boats are used in a variety of applications and are particularly useful in military operations, and search and rescue operations. When fast-moving small watercraft encounter even moderately disturbed water, the passengers are subjected to significant forces. At high-speed, in waves of any appreciable size, small watercraft tend to be subjected to rapid and simultaneous vertical and horizontal acceleration and deceleration.

When a boat moving at high speed impacts the crest of a wave, the boat tends to simultaneously pitch upwards and decelerate, and when it passes over or through the crest and encounters the trough, the boat tends to pitch downwards and accelerate. Al high speed, each pitching and acceleration/deceleration cycle may be measured in seconds, such that passengers are subjected to rapid and extreme acceleration and deceleration and the associated shock, which is commonly quantified. in terms of multiples of g, a "g" being a unit of acceleration equivalent to that exerted by the earth's gravitational field at the surface of the earth. The term g-force is also often used, but it is commonly understood. to mean a relatively long-term acceleration. A short-term acceleration is usually called a shock and is also quantified in terms of g.

Human tolerances for shock and g-force depend on the magnitude of the acceleration, the length of time it is applied, the direction in which it acts, the location of application, and the posture of the body. When vibration is experienced, relatively low peak g levels can be severely damaging if they are at the resonance frequency of organs and connective tissues. In high-speed watercraft, with the passengers sitting in a conventional generally upright position, which is typically required, particularly with respect to the helmsperson and any others charged with watchkeeping, upward acceleration of the watercraft is experienced as a compressive force to an individual's spine and rapid deceleration tends to throw an individual forward.

Shock absorbing systems for high-speed boats are known. For example, U.S. Pat. No. 6,786,172 (Loftier—Shock absorbing boat) discloses a horizontal base for supporting a steering station that that is hingedly connected to the transom to pivot about a horizontal axis. The base is supported by spring bias means connected to the hull.

Impact attenuation systems for aircraft seats are also known, as disclosed in: U.S. Pat. No. 4,349,167 (Reilly—Crash load attenuating passenger seat); U.S. Pat. No. 4,523,730 (Martin—Energy-absorbing seat arrangement); U.S. Pat. No. 4,911,381 (Cannon et al.—Energy absorbing leg assembly for aircraft passenger seats); U.S. Pat. No. 5,125,598 (Fox—Pivoting energy attenuating seat); and U.S. Pat. No. 5,152,578—Kiguchi—Leg structure of seat for absorbing impact energy.

Other seat suspension systems are also known, as disclosed in: U.S. Pat. No. 5,657,950 (Han et al.—Backward-leaning-movement seat leg structure); U.S. patent application Ser. No. 10/907,931 (App.) (Barackman et al.—Adjustable attenuation system for a space re-entry vehicle seat); U.S. Pat. No. 3,572,828 (Lehner—Seat for vehicle preferably agricultural vehicle); U.S. Pat. No. 3,994,469 (Swenson et al.—Seat suspension including improved damping means); and U.S. Pat. No. 4,047,759 (Koscinski—Compact seat suspension for lift truck).

SUMMARY

In one aspect, the present invention provides a suspension system for a suspended seat module on a high-speed water vessel having a usual direction of travel, the suspension system including: a shock absorbing assembly for resiliently suspending a seat module relative to a vessel, wherein the shock absorbing assembly tends to cause the seat module to remain in an upper at-rest position and to return to the at-rest position on cessation of a force causing the seat module to move generally vertically towards a bottom position; a suspension module configured to constrain the seat module to linear movement; and a support assembly for supporting portions of the seat module distal from the seat module, and configured to resist athwart movement of same.

The support assembly may include a spar assembly interconnected between the suspension module and the seat module wherein the connection between the spar assembly and one of the suspension module and the seat module permits fore and aft movement of the spar assembly relative to the one of the suspension module and the seat module.

The suspension system may include a shock absorber interposed between one of: the spar assembly and the seat module; and the spar assembly and the suspension module.

DETAILED DESCRIPTION WITH REFERENCE TO THE DRAWINGS

Figures 1, 2, 3, 4, 5, 6:
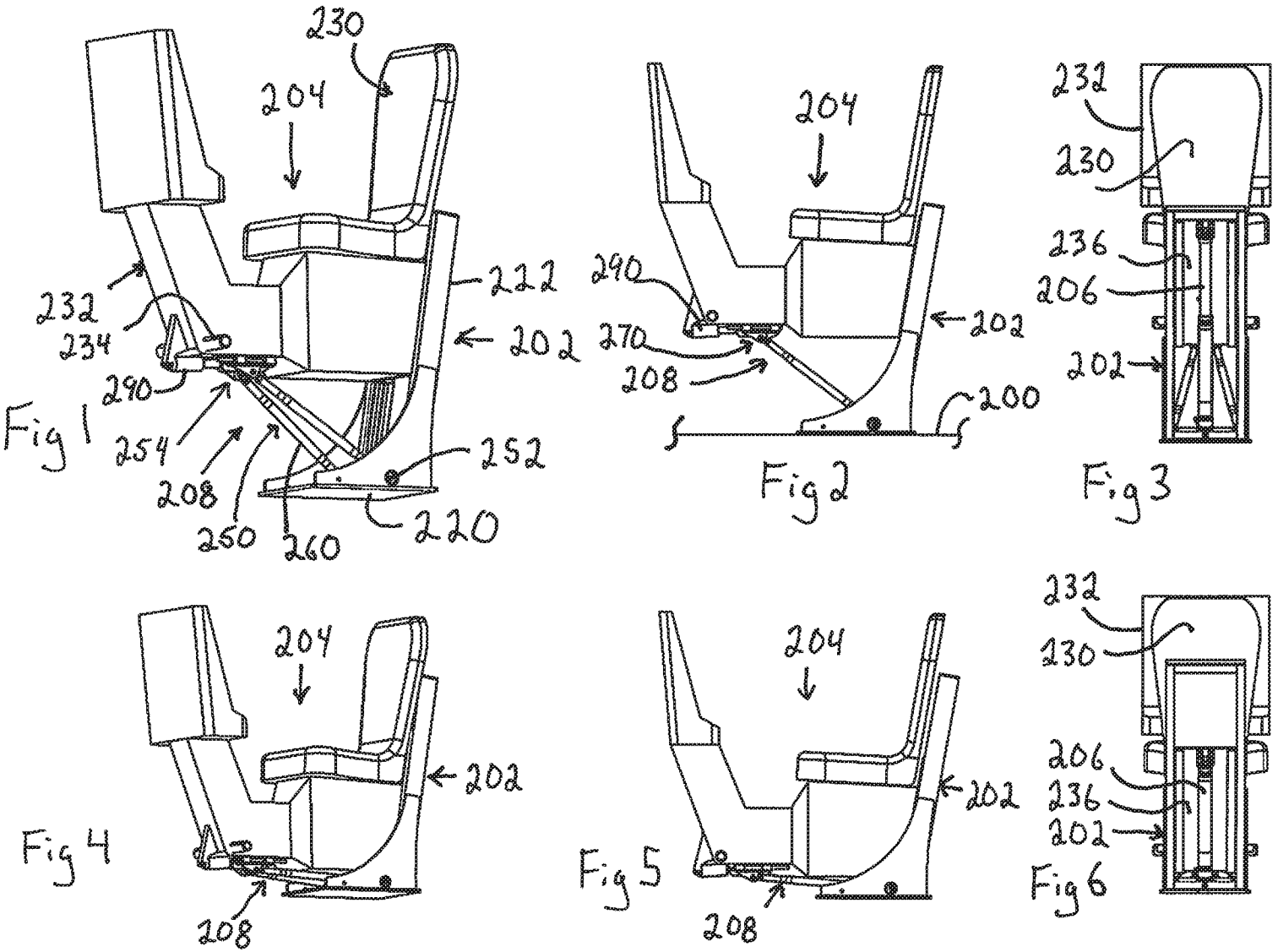
FIG. 1 is a perspective view of a suspended seat module embodiment of the present invention having two spars, a slide assembly and a shock absorber interconnected between the helm/control module and the slide assembly, shown in the upper at-rest position.
FIG. 2 is a side clew Lion view of the embodiment of FIG. 1, shown in the upper at-rest position.
FIG. 3, is a rear elevation view of the embodiment of FIG. 1, shown in the upper at-rest position.
FIG. 4, is a perspective view of the embodiment of FIG. 1, shown in the bottom position.
FIG. 5 is a side clew Lion view of the embodiment of FIG. 1, shown in the bottom position.
FIG. 6 is a rear elevation view of the embodiment of FIG. 1, shown in the bottom position.
Figure 8:
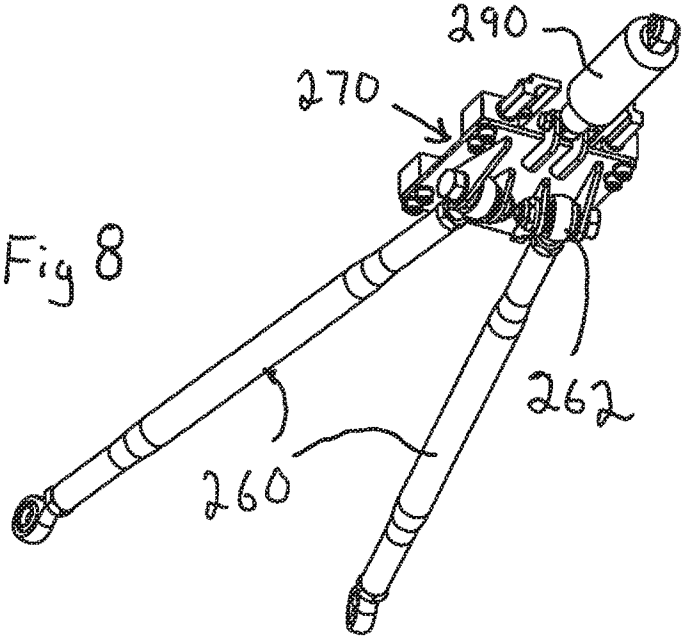
FIG. 8 is a perspective isolation from-below view of the slide assembly, shock absorber and spars of the embodiment shown in FIG. 1.
Figure 7:
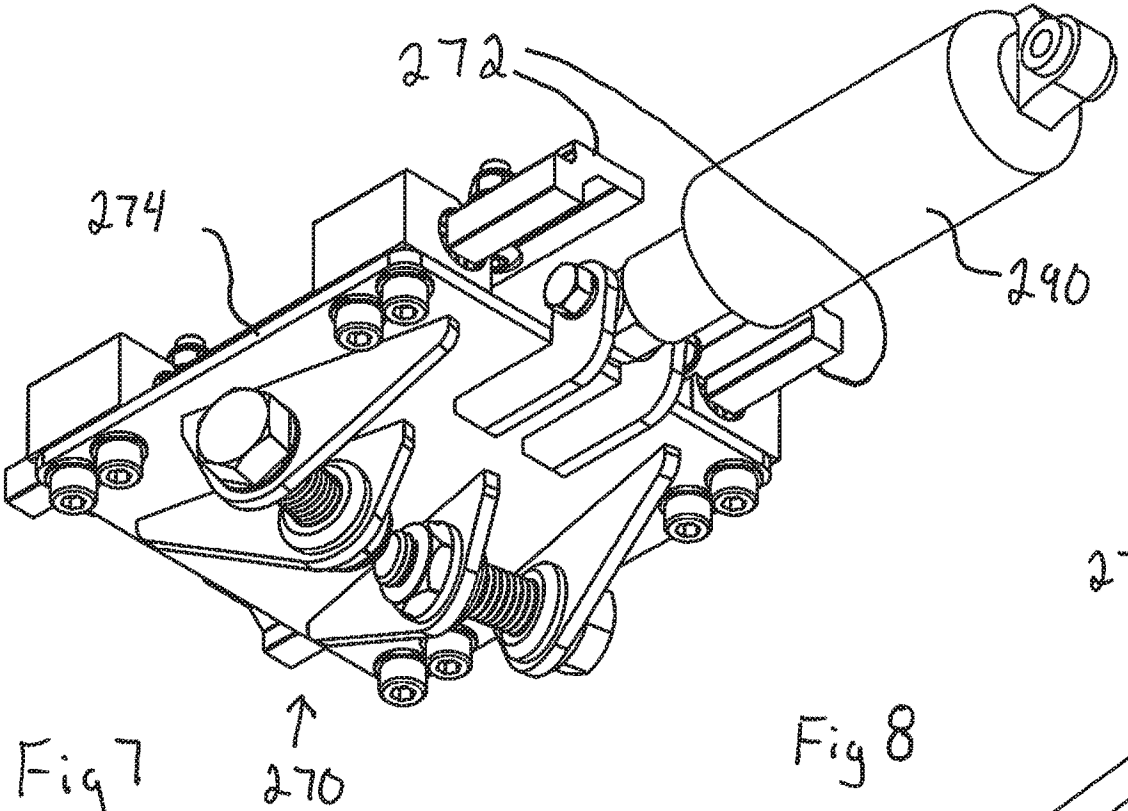
FIG. 7 is a perspective isolation from-below view of the slide assembly and shock absorber of the embodiment shown in FIG. 1.
Figure 10:
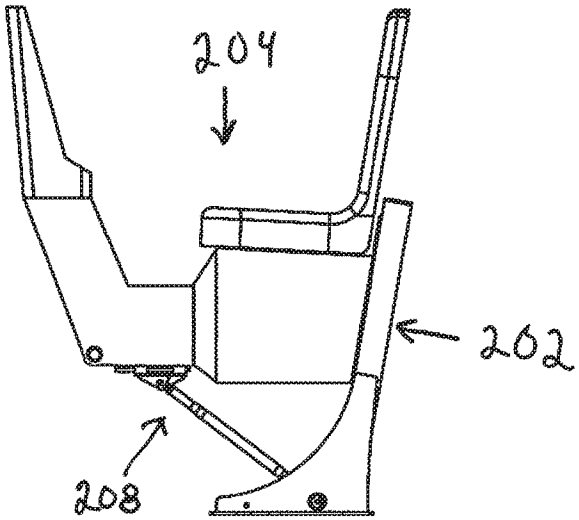
FIG. 10 is side clew Lion view of a suspended seat module embodiment of the present invention having two spars and a slide assembly (but no shock absorber), shown in the upper at-rest position.
Figure 11:
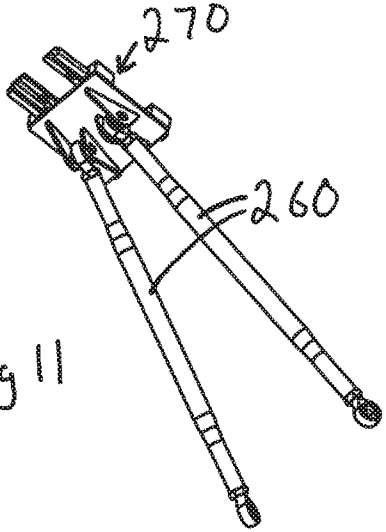
FIG. 11 is a perspective isolation from-below view of the slide assembly and spars of the embodiment shown in FIG. 10.
Figure 9:
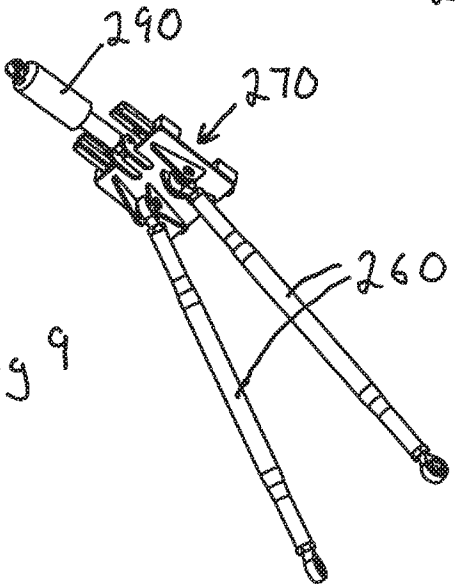
FIG. 9 is a perspective isolation from-below view of the slide assembly, shock absorber and spars of the embodiment shown in FIG. 1.
Figure 14:
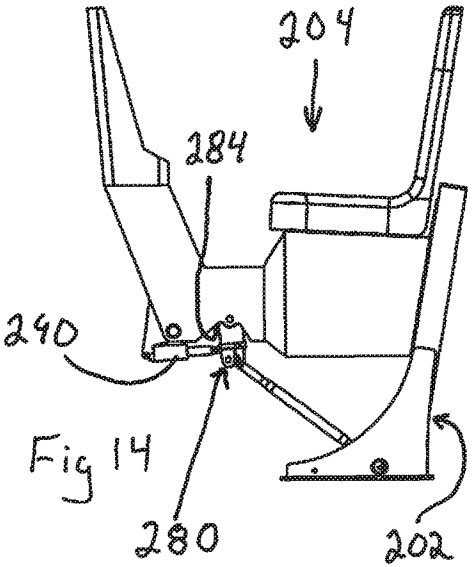
FIG. 14 is a side elevation view of a suspended seat module embodiment of the present invention having two spars, a pivoting assembly and a shock absorber interconnected between the helm/control module and the pivoting assembly, shown in the upper at-rest position.
Figure 12:
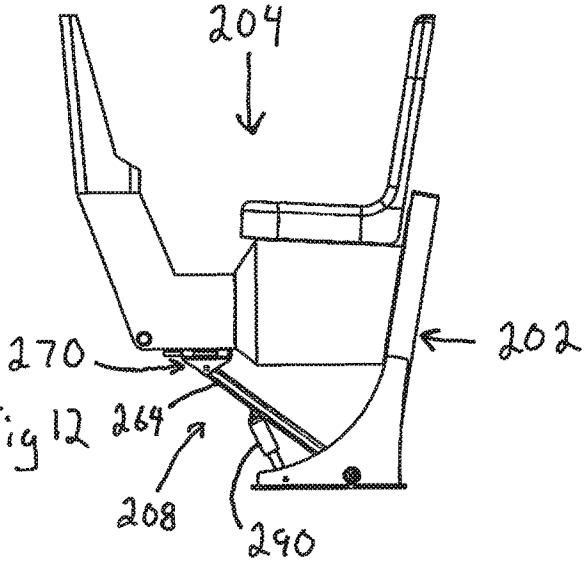
FIG. 12 is a side elevation view of a suspended seat module embodiment of the present invention having a single spar member, a slide assembly and a shock absorber interconnected between the spar member and the deck mount, shown in the upper at-rest position.
Figure 13:
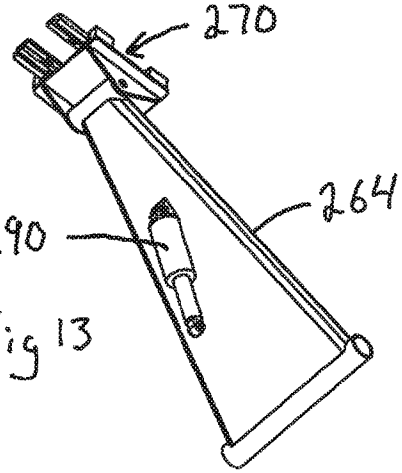
FIG. 13 is a perspective isolation from -below view of the slide assembly, spar member and shock absorber of the embodiment shown in FIG. 12.
Figure 15:
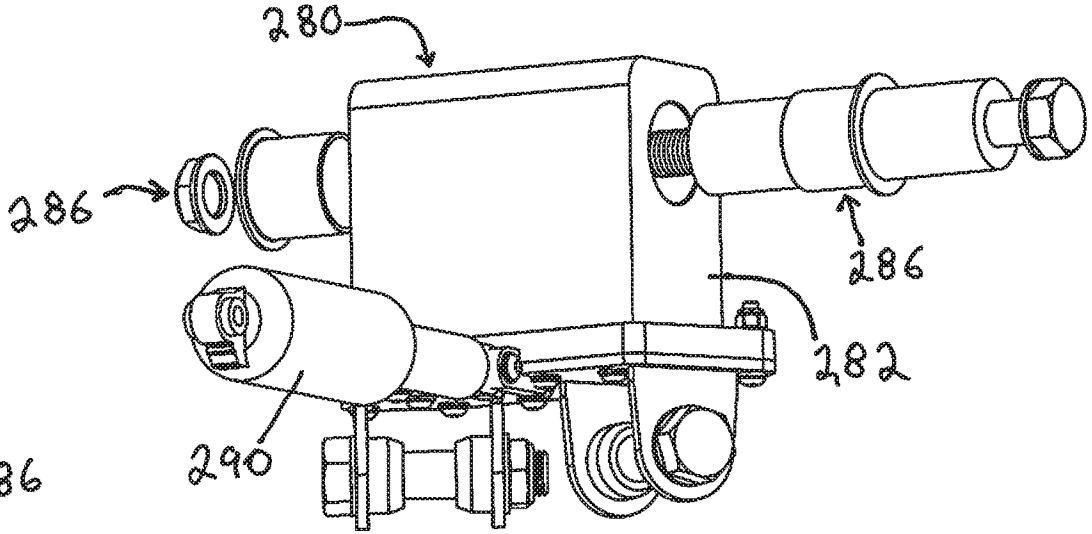
FIG. 15 is a partially exploded perspective isolation view of the pivot block, pivot pin assembly and shock absorber of the embodiment shown in FIG. 14.
Figure 16:
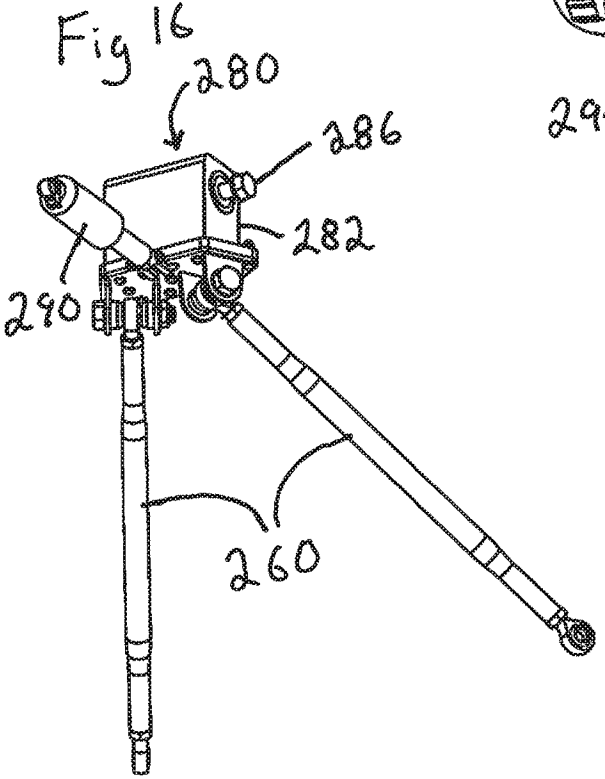
FIG. 16 is a perspective isolation from-below view of the pivot block, pivot pin assembly, shock absorber and spars of the embodiment shown in FIG. 14.
Figure 19:
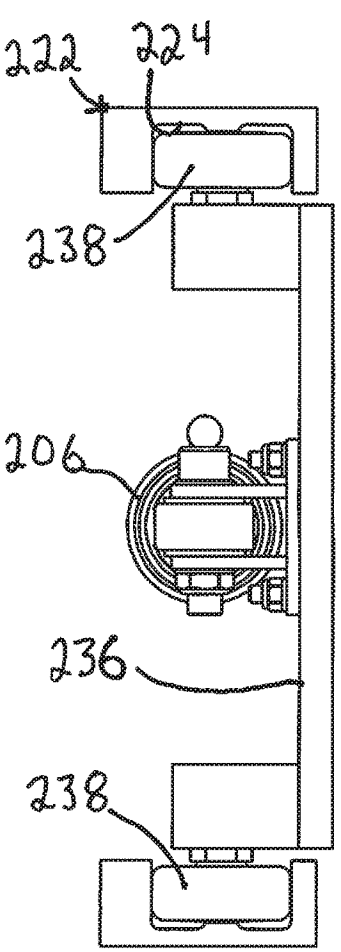
FIG. 19 is a sectional view of the guide rail assembly, carriage and strut, with the section taken perpendicular to the longitudinal axis of the channels.
Figure 18:
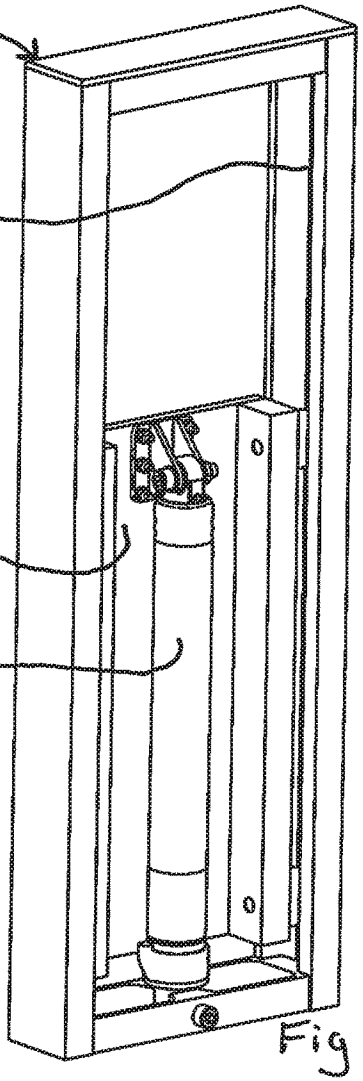
FIG. 18 is a perspective isolation view of the guide rail assembly, carriage and strut shown in the bottom position.
Figure 17:
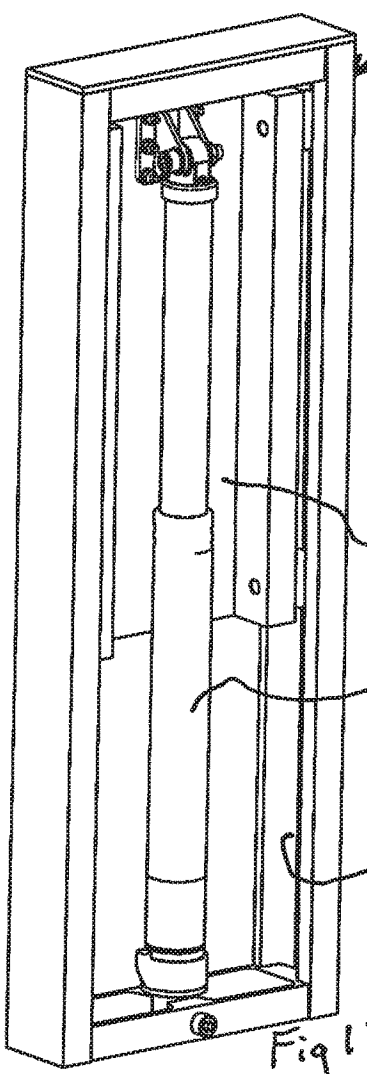
FIG. 17 is a perspective isolation view of the guide rail assembly, carriage and strut shown in the upper at-rest position.

In this specification, including the claims, terms conveying an absolute direction (for example, up, down, vertical etc.) or absolute relative positions (for example, top, bottom etc.) are used for ease of understanding and such absolute directions and relative positions may not always pertain. As well, in this specification, including the claims, terms relating to directions and relative orientations on a watercraft, for example, port, starboard, forward, aft, fore and aft (which when used herein means a generally horizontal direction generally parallel to the direction of travel of the vessel), bow, stern, athwart (which when used herein means a generally horizontal direction generally perpendicular to the direction of travel of the vessel) etc. are used for ease of understanding and such terms may not always pertain.

As well, in this specification, including the claims, the terms "roll" and "pitch" are used to refer to movement relative to an imaginary line parallel to the nominal direction of travel of the vessel or object, and passing through the center of mass of the vessel or object, with "roll" being quasi-pivotal or quasi-rotational lateral movement with respect to the imaginary line, and "pitch" being a generally vertical angle of displacement (e.g. bow up or bow down) caused by a vertical force applied at a distance from the center of mass.

Suspended seat module embodiments for at aching to a deck 200 (i.e., a suitable section of a water vessel) are shown in the drawings.

The suspended seat module embodiments include a main suspension module 202, a seat module 204, and interposed between the main suspension module 202 and the seat module 204, a strut 206 and a support assembly 208.

The main suspension module 202 includes a deck mount 220 (preferably aluminum) configured for attaching to the deck 200, and projecting upwards (preferably angled rearward from vertical) from the deck mount 220, a guide rail assembly 221. The guide rail assembly 222 includes two spaced-apart opposed channels 224. The guide rail assembly 222 is preferably anodized aluminum and may be bolted to the deck mount 220.

The seat module 204 includes a seat 230 (preferably comprising foam cushions covered in a sturdy upholstery material), a forward projecting helm/control module 232 (which may be any one of, or combinations of a vessel control module, a communications module, a navigation module or other user specific module, e.g., a surveying module), with foot pegs 234 on which a user may rest his or her feet during use, and a carriage 236. The seat 230 and helm/control module 232 preferably have an aluminum frame and may include a storage box made from welded aluminum sheet metal.

The carriage 236 is preferably anodized aluminum and includes anodized aluminum axles supporting rollers 238, preferably made from hard, low-friction plastic acetal), and sized and oriented to slide within the channels 224, so as to restrict the seat module 204 to movement parallel to the channels 224.

The strut 206 is interconnected between the main suspension module 202 and the carriage 236. Preferably, the strut 206 is attached to the carriage 236 via a stainless steel bracket bolted to the carriage 236, and the strut 206 is attached to the main suspension module 202 via a direct attachment to the guide rail assembly 222. The strut 206 may be any suitable type of shock absorber such as an air shock, MacPherson strut etc. The strut 206 tends to resiliently suspend the seat module 204 relative to the vessel, in that the strut 206 tends to cause the seat module 204 to remain in an upper at-rest position and to return to the at-rest position on cessation of a force causing the seat module 204 to move generally vertically towards a bottom position.

The support assembly 208 is interconnected between the deck mount 220 and the helm/control module 232. The support assembly 208 comprises a spar assembly 250, a simple pivot connector 252 at one end of the spar assembly 250, and a fore-and-aft movement connector 254 at the other end of the spar assembly 250. In the embodiments shown in the drawings and described herein, the simple pivot connector 252 connects the spar assembly 250 to the deck mount 220 and the fore-and-aft movement connector 254 connects the spar assembly 250 to the helm/control module 232. However, it wilt be apparent that similar results could be achieved with a pivot connection between the spar assembly 250 and the helm/control module 232, and a connection permitting fore-and-aft movement between the spar assembly 250 and the deck mount 220.

In one embodiment, the spar assembly 250 includes two spars 260, (preferably having heim joints 262, also referred to as rod end bearings and rose joints, at each end). The spars 260 are oriented such that the ends of the spars 260 at the deck mount 220 are spaced wider apart than the ends of the spars 260 at the helm/control module 232.

In another embodiment, the spar assembly 250 comprises a single spar member 264 configured such that simple pivot connection 252 at the deck mount 220 includes spaced-apart connection locations no as to provide resistance to athwart forces.

In one embodiment, the fore-and-aft movement connector 254 comprises a sliding assembly 270, comprising a track assembly 272 slidably engaged with a car assembly 274. The track assembly 272 comprises two parallel anodized aluminum rails. In the drawings, the parallel anodized aluminum rails are shown bolted directly to the seat module 204. Alternatively, for tighter tolerances, the parallel anodized aluminum rails may be bolted to an adapter plate machined flat. The car assembly 274 comprises anodized aluminum cars containing a tow friction plastic sliding element configured to slidably engage with the parallel anodized aluminum rails, the aluminum cars being bolted to a welded stainless steel bracket. The sliding assembly 270 permits linear movement (defined by the engagement of the track assembly 272 and car assembly 274), as between the helm/control module 232 and the adjacent end of the spar assembly 250.

In another embodiment, the fore-and-aft movement connector 254 comprises a pivoting assembly 280, comprising a pivot block 282 (preferably anodized aluminum), a pivot cavity 284 and a pivot pin assembly 286 (preferably comprising a stainless steel pivot axle, held in place with a large hex bolt, with plastic bushings on which to pivot). The pivoting assembly 280 permits arcuate movement (defined by the pivotal movement of the pivot block 282 relative to the pivot cavity 284), as between the helm/control module 232 and the adjacent end of the spar assembly 250.

Embodiments of the support assembly 208 may also include a shock absorber 290 to reduce the cantilever forces transmitted from the seat module 204 to the main suspension module 202, during use. The shock absorber 290 may be interconnected between the helm/control module 232 and the fore-and-aft movement connector 254 or may be interconnected between the spar assembly 270 and the deck mount.

A preferred embodiment of the general configuration shown in FIG. 1, that is, an embodiment having a support assembly 208 with two spars 260, a sliding assembly 270 and a shock absorber 290, has the following features. A typical seat module 204 of the preferred embodiment projects about 4 feet from the main suspension module 202, is about 2 feet wide, has a vertical dimension of about 3½ feet and weighs about 35 lbs.

The guide rail assembly 222 of the preferred embodiment is tilted aft 10 degrees from vertical (in this context, "vertical" assumes the vessel is at rest and at a desired trim). Each spar 260 has a mount center to mount center length of 22½ inches, and is made from 1¼ inch diameter swaged aluminum tube with a stainless steel rod end at each end. The two spars are positioned such that with the seat module 204 in the upper at-rest position, an imaginary plane defined by the two spars 260 is tilted forward 52 degrees from vertical; and with the seat module 204 in the bottom position, the imaginary plane defined by the two spars 260 is tilted forward 88 degrees from vertical.

In the preferred embodiment, the strut 206 preferably has a travel of about 12 inches. It has been found that a suitable strut 206, is the Fox Racing Shocks, Fox Float 12" (Part #: 939-99-007). A suitable operating pressure for the Fox Float 12" has been found to be 65 psi, but this may be adjusted up or down by the user depending on ride conditions and the weight of the occupant/payload, In the preferred embodiment, the shock absorber 290 has a travel of about 2½ inches. It has been found that a suitable shock absorber 290 is the Fox Racing Shocks, Fox Float CTD 8.50"×2.50" (Part #: 972-01-230). A suitable operating pressure for the Fox Float CTD 8.50"×2.50" has been found to be 150 psi.

To be clear, as indicated above, it has been found that tilting the guide rail assembly 222 aft 10 degrees from vertical, provides desirable performance with respect to the combination of pitch and deceleration experienced in a wide range of operating conditions. However, a user may find a different angle may be better suited for a particular vessel or particular prevailing operating conditions. The main suspension module 202 may be configured to permit adjustment of the tilt of guide rail assembly 222. Further, the guide rail assembly 222 described herein is configured to restrict seat module 204 to a defined linear reciprocating path. It has been found that restricting the seat module 204 to a defined linear reciprocating path provides desirable performance with respect to the combination of pitch and deceleration experienced in a wide range of operating conditions. However, the guide rail assembly 222 could be configured to restrict the seat module 204 to a defined non-linear reciprocating path, that is, a simple or complex curve, if this were found to be better suited for a particular vessel or particular prevailing operating conditions.

The scope of the claims should not be limited by the preferred embodiments set forth in the examples, but should be given the broadest interpretation consistent with the description as a whole.

What is claimed is:

1. A marine suspension system for a water vessel having forward and aft directions and athwart dimensions, the marine suspension system comprising:

a seat module having a proximal carriage and a distal projection;

a guide assembly having a bottom for fixing to a water vessel, the guide assembly engaged with the carriage so as to define a reciprocating path of movement for the seat module;

a first shock absorbing device for resiliently suspending the seat module relative to the guide assembly, wherein the first shock absorbing device tends to cause the seat module to remain in an upper at-rest position on the path of movement and to return to the at-rest position on cessation of a force causing the seat module to move generally vertically towards a lower position on the path of movement;

a support assembly interposed between the vicinity of the bottom of the guide assembly and the distal projection, for resisting athwart movement of the distal projection.

2. The marine suspension system of claim 1, wherein the support assembly comprises:

a spar assembly having a spar assembly proximal end in the vicinity of the bottom of the guide assembly and a spar assembly distal end proximate the distal projection;

a simple pivot connector at one of the spar assembly proximal end and the spar assembly distal end; and a fore-and-aft movement connector at the other one of the spar assembly proximal end and the spar assembly distal end.

3. The marine suspension system of claim 1, wherein the support assembly comprises:

a spar assembly having a spar assembly proximal end in the vicinity of the bottom of the guide assembly and a spar assembly distal end proximate the distal projection;

a simple pivot connector at the spar assembly proximal end; and a fore-and-aft movement connector at the spar assembly distal end.

4. The marine suspension system of claim 3, wherein:

the spar assembly distal end has a distal end athwart dimension;

the spar assembly proximal end has a proximal end athwart dimension; and the resisting athwart movement of the distal projection is at least in part provided by the proximal end athwart dimension being greater than the distal end athwart dimension.

5. The marine suspension system of claim 3, wherein the fore-and-aft movement connector provides for pivotal and linear movement of the spar assembly distal end relative to the distal projection.

6. The marine suspension system of claim 5, wherein the fore-and-aft movement connector comprises a sliding assembly comprising:

a track assembly mounted to the distal projection;

a car assembly in sliding engagement with the track assembly and pivotally connected to the spar assembly distal end.

7. The marine suspension system of claim 3, wherein the fore-and-aft movement connector provides for pivotal and arcuate movement of the spar assembly distal end relative to the distal projection.

8. The marine suspension system of claim 7, wherein the fore-and-aft movement connector comprises a pivoting assembly comprising:

a pivot mount attached to the distal projection; and a pivot block having an upper block section pivotally mounted to the pivot mount and a lower block section pivotally connected to the spar assembly distal end.

9. The marine suspension system of claim 3, further comprising a second shock absorber device interposed between the spar assembly distal end and the distal projection, to support the distal projection by resiliently impeding forward movement of the spar assembly distal end.

10. The marine suspension system of claim 3, further comprising:

a deck mount to which the guide assembly is attached, wherein the simple pivot connector at the spar assembly proximal end in the vicinity of the bottom of the guide assembly, is provided by the deck mount; and a second shock absorber device interposed between the spar assembly and the deck mount, to support the distal projection by resiliently impeding forward movement of the spar assembly distal end.

11. The marine suspension system of claim 1, wherein the path of movement for the seat module is linear.

12. The marine suspension system of claim 1, wherein the distal projection comprises one or more of: a vessel control module, a communications module and a navigation module.

13. A marine suspension system for a water vessel having forward and aft directions and athwart dimensions, the marine suspension system comprising:

a deck mount for fixing to a water vessel and providing a simple pivotal mount;

a seat module having a proximal carriage and a distal projection;

a guide assembly having a bottom attached to the deck mount in the vicinity of the simple pivotal mount, and the guide assembly engaged with the carriage no as to define a linear reciprocating path of movement for the seat module;

a first shock absorbing device interposed between the carriage and the deck mount, for resiliently suspending the seat module, wherein the first shock absorbing device tends to cause the seat module to remain in an upper at-rest position on the path of movement and to return to the at-rest position on cessation of a force causing the seat module to move generally vertically towards a lower position on the path of movement;

a support assembly for resisting athwart movement of the distal projection, the support assembly comprising:

a fore-and-aft movement connector attached to the distal projection; and a spar assembly comprising a spar assembly proximal end pivotally mounted at the simple pivotal mount and a spar assembly distal end pivotally connected to the fore-and-aft movement connector;

a second shock absorbing device interposed. between the spar assembly distal end and the distal projection, to support the distal projection by resiliently impeding forward movement of the spar assembly distal end.

14. The marine suspension system of claim 13, wherein:

the spar assembly distal end has a distal end athwart dimension;

the spar assembly proximal end has a proximal end athwart dimension; and the resisting athwart movement of the distal projection is at least in part provided by the proximal end athwart dimension being greater than the distal end athwart dimension.

15. The marine suspension system of claim 13, wherein the fore-and-aft movement connector comprises a pivoting assembly comprising:

a pivot mount attached to the distal projection; and a pivot block having:

an upper block section pivotally mounted to the pivot mount; and a lower block section;

wherein the pivotal connection of the spar assembly distal end to the fore-and-aft movement connector comprises a pivotal connection of the spar distal end to the lower block section.

16. The marine suspension system of claim 13, wherein the fore-and-aft movement connector comprises:

a track assembly mounted to the distal projection; and a car assembly in sliding engagement with the track assembly;

wherein the pivotal connection of the spar assembly distal end to the fore-and-aft movement connector comprises a pivotal connection of the spar distal end to the car assembly.

17. The marine suspension system of claim 13, wherein the deck mount is configured to orient the guide assembly so that the linear reciprocating path of movement for the seat module is tilted aft 10 degrees from vertical with the water vessel at rest and at a desired trim.

18. The marine suspension system of claim 17, wherein the spar assembly has a range of pivotal movement relative to the simple pivotal mount, the range being, with the water vessel at rest and at a desired trim, tilted forward from vertical about 52 degrees to tilted forward from vertical about 88 degrees.

19. The marine suspension system of claim 17, wherein:

the simple pivotal mount defines a spar assembly proximal end pivot axis;

the pivotal connection between the spar assembly distal end and the fore-and-aft movement connector defines a spar assembly distal end pivot axis;

the spar assembly proximal end pivot axis and the spar assembly distal end pivot axis are substantially parallel one to the other and are spaced apart about 22 inches;

the first shock absorbing device has a travel of about 12 inches; and the second shock absorbing device has a travel of about 2½ inches.

20. The marine suspension system of claim 19, wherein:

the first shock absorbing device is an air shock that in use has an operating pressure of about 65 psi; and the second shock absorbing device is an air shock that in use has an operating pressure of about 150 psi.

* * * * *